US009358788B2

(12) United States Patent
MacKenzie et al.

(10) Patent No.: US 9,358,788 B2
(45) Date of Patent: Jun. 7, 2016

(54) PRINT HEAD DIE

(71) Applicant: Hewlett-Packard Development Company, L.P., Houston, TX (US)

(72) Inventors: Mark H. MacKenzie, Corvallis, OR (US); Matthew A. Shepherd, Vancouver, WA (US); Wesley R. Schalk, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/861,635

(22) Filed: Sep. 22, 2015

(65) Prior Publication Data

US 2016/0009083 A1 Jan. 14, 2016

Related U.S. Application Data

(63) Continuation of application No. 14/418,422, filed as application No. PCT/US2012/057040 on Sep. 25, 2012, now Pat. No. 9,168,739.

(51) Int. Cl.

| | |
|---|---|
| ***B41J 2/15*** | (2006.01) |
| ***B41J 2/145*** | (2006.01) |
| ***B41J 2/14*** | (2006.01) |

(52) U.S. Cl.

CPC ..... *B41J 2/145* (2013.01); *B41J 2/14145* (2013.01)

(58) Field of Classification Search

CPC ..... B41J 2/14; B41J 2/14145; B41J 2/155; B41J 2/145; B41J 2/14024; B41J 2202/19; B41J 2202/20; B41J 2202/21

See application file for complete search history.

(56) References Cited

U.S. PATENT DOCUMENTS 6,450,614 B1 * 9/2002 Scheffelin ..... B41J 2/14024 347/13
6,520,624 B1 * 2/2003 Horvath ..... B41J 2/14024 347/13
6,520,626 B1 2/2003 Murakami
6,705,716 B2 3/2004 Mott
7,207,650 B2 * 4/2007 Ikemoto ..... B41J 2/04543 347/42
8,141,990 B2 3/2012 Pidwerbecki et al.
2003/0214558 A1 11/2003 Kim et al.

FOREIGN PATENT DOCUMENTS

WO WO-2010005434 1/2010

OTHER PUBLICATIONS

PCT International Search Report for PCT/US2012/057040 dated Apr. 16, 2013.

* cited by examiner

*Primary Examiner* — Juanita D Jackson
(74) *Attorney, Agent, or Firm* — HP Inc. Patent Department

(57) ABSTRACT

Various configurations of print head die are described. In an example, a first print head die has first print structures disposed along a major dimension thereof perpendicular to the media path, the first print structures including a leading print structure with respect to the media path. A second print head die independent of the first print head die has second print structures disposed along a major dimension thereof perpendicular to the media path, the second print head die being staggered with respect to the first print head die along the media path, the second print structures including a leading print structure with respect to the media path. An extent between respective leading print structures of the first and second print head dies is between a minimum equal to a width of the first print head plus 100 μm and a maximum value such that the distance along the media path between any of the first print structures and any of the second print structures does not exceed 10 mm.

17 Claims, 5 Drawing Sheets

500

PRINT HEAD DIE

The present application is a continuation application claiming priority under 35 USC 120 from U.S. application Ser. No. 14/418,422 filed on Jan. 29, 2015 and entitled PRINT HEAD DIE, now U.S. Pat. No. 9,168,739, which claims priority under 35 USC 119 from PCT/US2012/057,040 filed on Sep. 25, 2012 and entitled PRINT HEAD DIE, the full disclosures of which are hereby incorporated by reference.

BACKGROUND

In some inkjet printers, a stationary media wide printhead assembly, commonly called a print bar, is used to print on paper or other print media moved past the print bar. The print bar can include a page-wide array of print heads to print across the width of a medium in fewer passes or even a single pass. Printing with page wide array print heads may be subject to print quality defects due to spacing between print head dies.

BRIEF DESCRIPTION OF THE DRAWINGS

Some embodiments of the invention are described with respect to the following figures.

DETAILED DESCRIPTION

Figure 1:
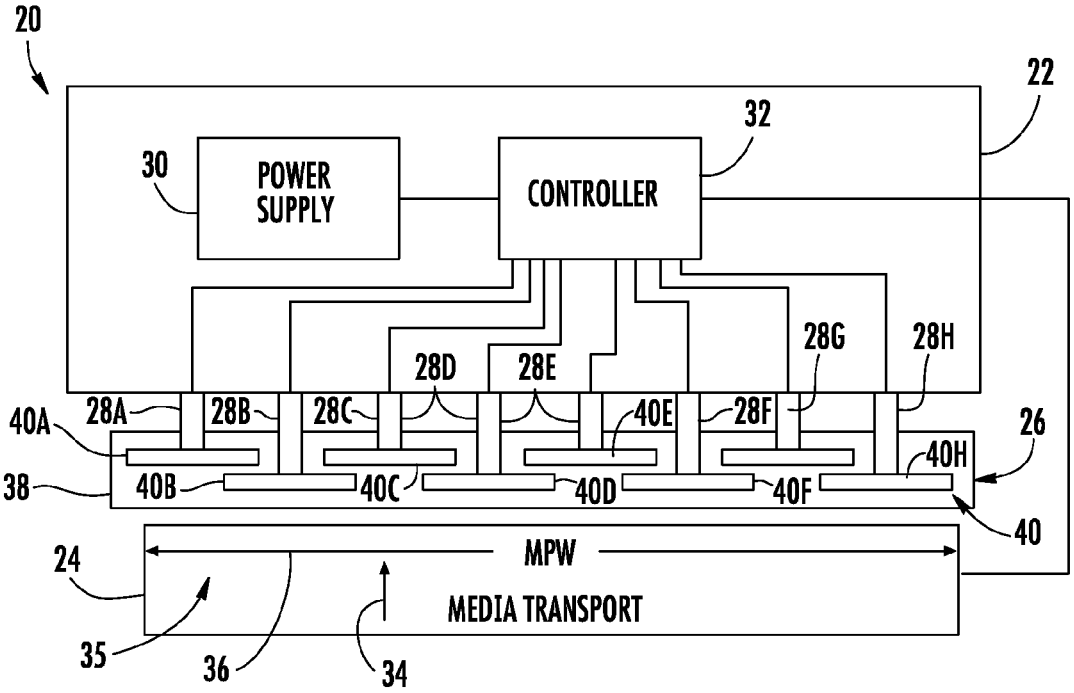
FIG. 1 is a schematic illustration of an example printing system including a page wide array of staggered and overlapping print head dies.

FIG. 1 illustrates an example printing system 20 with portions schematically shown. As will be described hereafter, printing system 20 communicates with multiple staggered and overlapping print head dies such that the print head dies may be more closely spaced to reduce print quality defects. Printing system 20 comprises a main control system 22, media transport 24, page wide array 26 and the electrical interconnects 28A, 28B, 28C, 28D, 28E, 28F, 28G and 28H (collectively referred to as interconnects 28).

Main control system 22 comprises an arrangement of components to supply electrical power and electrical control signals to page wide array 26. Main control system 22 comprises power supply 30 and controller 32. Power supply 30 comprises a supply of high voltage. Controller 32 comprises one or more processing units and/or one or more electronic circuits configured to control and distribute energy and electrical control signals to page wide array 26. Energy distributed by controller 32 may be used to energize firing resisters to vaporize and eject drops of printing liquid, such as ink. Electrical signals distributed by controller 32 control the timing of the firing of such drops of liquid. Controller 32 further generates control signals controlling media transport 28 to position media opposite to page wide array 26. By controlling the positioning a media opposite to page wide array 26 and by controlling the timing at which drops of liquid are eject or fired, controller 32 generates patterns or images upon the print media.

Media transport 24 comprises a mechanism configured to position a print medium with respect to page wide array 26. In one implementation, media transport 24 may comprise a series of rollers to drive a sheet of media or a web of media opposite to page wide array 26. In another implementation, media transport 24 may comprise a drum about which a sheet or a web of print media is supported while being carried opposite to page wide array 26. As shown by FIG. 1, media transport 28 moves print medium in a direction 34 along a media path 35 having a width 36. The width 36 is generally the largest dimension of print media that may be moved along the media path 35.

Page wide array 26 comprises support 38, printing liquid supplies 39 and print head dies 40A, 40B, 40C, 40D, 40E, 40F, 40G and 40H (collectively referred to as print head dies 40). Support 38 comprises one or more structures that retain, position and support print head dies 40 in a staggered, overlapping fashion across width 36 of media path 35. In the example implementation, support 38 staggers and overlaps printer dies 40 such that an entire desired printing width or span of the media being moved by media transport 34 may be printed in a single pass or in fewer passes of the media with respect to page wide array 26.

Figure 2:
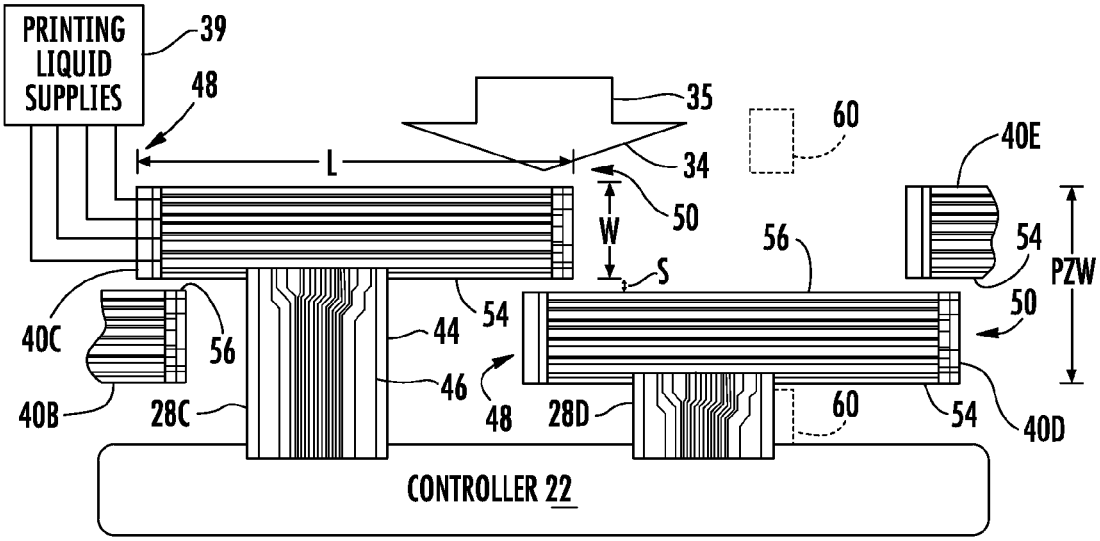
FIG. 2 is an enlarged view of a portion of FIG. 1 illustrating the example printing system.

Printing liquid supplies 39, one of which is schematically shown in FIG. 2, comprise reservoirs of printing liquid. Supplies are fluidly connected to each of dies 40 so as to supply printing liquid to dies 40. In one implementation, printing liquid supplies 39 supply multiple colors of ink to each of print head dies 40. For example, in one implementation, printing liquid supply 39 supplies cyan, magenta, yellow and black inks to each of dies 40. In one implementation, printing liquid supplies 39 are supported by support 38. In another implementation, printing liquid supplies 39 comprise off-axis supplies.

Print head dies 40 comprise individual structures by which nozzles and liquid firing actuators are provided for ejecting drops of printing liquid, such as ink. FIG. 2 illustrates print head dies 40C and 40D, and their associated electrical interconnects 28C and 28D, respectively, in more detail. As shown by FIG. 2, each of print head dies 40 has a major dimension, length L, and a minor dimension, width W. The length L of each print head die 40 extends perpendicular to direction 34 of the media path 35 while partially overlapping the length L of adjacent print head dies 40. The width W of each print head die 40 extends in a direction parallel to direction 34 of the media path 35.

Interconnects 28 comprise structures 44 supporting or carrying electrically conductive lines or traces 46 to transmit electrical energy (electrical power for firing resisters and electrical signals or controlled voltages to actuate the supply of the electrical power to the firing resisters) from controller 22 to the firing actuators of the associated print head die 40. Interconnects 28 are electrically connected to each of their associated print head dies 40 along the major dimension, length L, of the associated die 40. Interconnects 28 are spaced from opposite ends 48 and 50 of the associated print head die 40. Interconnects 28 do not extend between sides 54 and 56 of consecutive print head dies 40. Because interconnects 28 are spaced from opposite ends 48, 50 and do not extend between sides 54 and 56 of consecutive print head dies 40, interconnects 28 do not obstruct or interfere with overlapping of consecutive print head dies 40. As a result, dies 40 may be more closely spaced to one another in direction 34 (the media axis or media advanced direction) to reduce the spacing S between sides 54 and 56 of consecutive dies 40.

Because printing system 20 reduces the spacing S between sides 54, 56 of consecutive print head dies 40, printing system 20 has a reduced print zone width PZW which enhances dot placement accuracy and performance. In implementations in which different colors of ink are deposited by each of the print head dies 40, reducing the print zone width PZW allows different dies 40 to deposit droplets of colors on the print media closer in time for enhanced and more accurate color mixing and/or half-toning. In implementations in which media transport 24 drives or guides the print media opposite to dies 40 using one or more rollers 60 on opposite sides of the print zone, reducing the print zone with PZW allows such rollers 60 (shown in broken lines in FIG. 2) to be more closely spaced to each another adjacent to the print zone. As a result, skewing or otherwise incorrect positioning of print media opposite to print head dies 40 by rollers 60 is reduced to further enhance print quality.

In the example implementation illustrated, each of interconnects 28 is physically and electrically connected to an associated print head die 40 while being centered between opposite ends of length L. As a result, consecutive print head dies 40 on each side of the interconnects 28 may be equally overlap with respect to the intermediate print head die 40. In other implementations, interconnects 28 may be physically and electrically connected to an associated print head die 40 asymmetrically between ends 48, 50 of the die 40.

Figure 3:
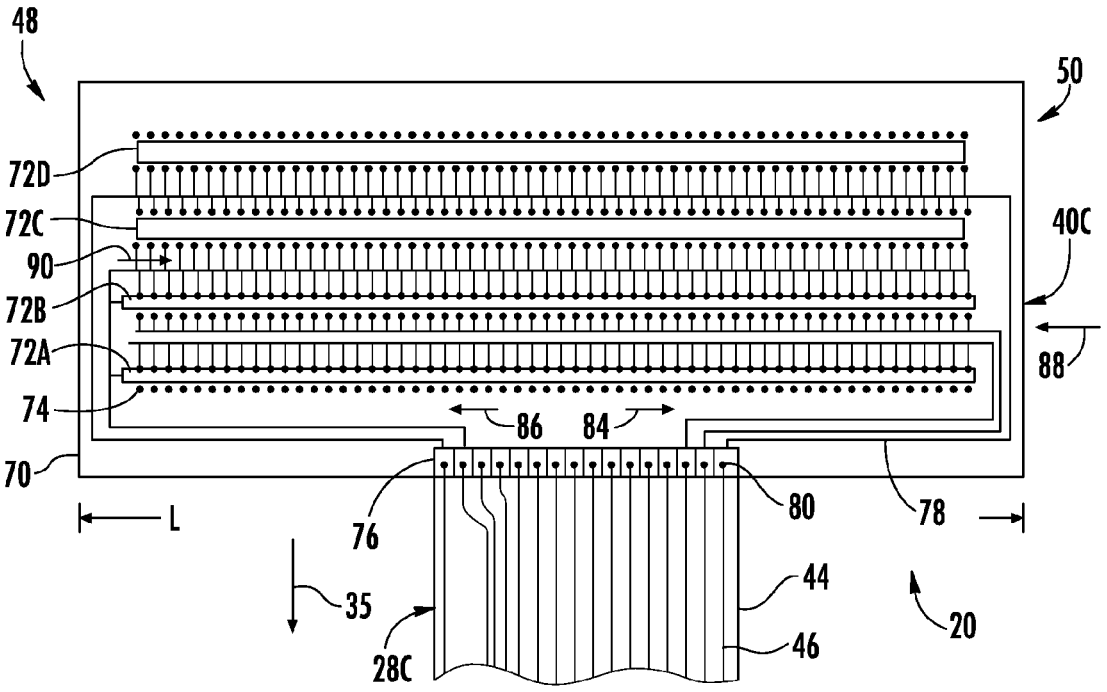
FIG. 3 schematically illustrates one example of print head die and its associated electrical interconnect.

FIG. 3 schematically illustrates one example of print head die 40C and its associated electrical interconnect 28C. Each of the other print head dies 40 and their associated electrical interconnects 28 may be substantially identical to the print head die 40C and electrical interconnect 28C being shown. As shown by FIG. 3, print head die 40C comprises a substrate 70 forming or providing liquid feed slots 72A, 72B, 72C and 72D (collectively referred to as slot 72) to direct printing liquids received from supply 39 (shown in FIG. 2) to each of the nozzles 74 extending along opposite sides of each of slots 72. In one implementation, liquid feed slots 72 supply cyan, magenta, yellow and black ink to the associated nozzle 74 on either side of the slot 72.

Nozzles 74 comprise openings through which drops of printing liquid is ejected onto the print medium. In one implementation, print head die 40 comprises a thermoresistive print head in which firing actuators or resisters substantially opposite each nozzle are supplied with electrical current to heat such resisters to a temperature such that liquid within a firing chamber opposite each nozzle is vaporized to expel remaining printing liquid through the nozzle 74. In another implementation, print head die 40 may comprise a piezoresistive type print head, wherein electric voltage is applied across a piezoresistive material to cause a diaphragm to change shape to expel printing liquid in a firing chamber through the associated nozzle 74. In still other implementations, other liquid ejection or firing mechanisms may be used to selectively eject printing liquid through such nozzle 74.

To facilitate the supply of electrical current to the firing mechanisms associate with each of nozzle 74, print head die 40C further comprises electrical connectors 76 and electrically conductive traces 78. Electrical connectors 76 comprise electrically conductive pads, sockets, or other mechanisms or surfaces by which traces 78 of die 40C may be electrically connected to corresponding electrically conductive traces 46 of electrical interconnect 28C. Electrical connectors 76 extend along the major dimension or length L of print head die 40C facilitate electrical connection of interconnect 44 to the major dimension or length L of print head die 40C. In the example illustrated, electrical connectors 76 comprise electrically conductive contact pads or contact surfaces against which electrical leads 80 of traces 46 are connected. In other implementations, the electrical connector 76 may comprise other structures facilitating electrical connection or electrical attachment of traces 46 of interconnect 28C to traces 78 of die 40C.

Electrically conductive traces 78 (a portion of which are schematically shown in FIG. 3) comprise lines of electrically conductive material formed upon substrate 70. Electrically conductive traces 78 transmit electrical power as well as electrical control signals to the firing mechanisms associate with each of nozzles 74. As shown by FIG. 3, electrically conductive traces 78 extend from electrical connectors 76 in outward directions 84, 86 perpendicular to the media path 35, extend around the ends of slots 72 and extend in inward directions 88, 90 between slots 72. Electrically conductive traces 78 are further connected to the liquid ejection mechanisms or firing actuators for each of nozzles 74. In one implementation, electrically conductive traces 78 extend between slots 72 from one end to the other end of die 40C. In another implementation, electrically conductive traces 78 extend between slots 72 from both ends 48, 50, one trace 78 extending a first portion of the distance from a left end 48 of die 40C and another trace 78 extending a portion of the distance from a right end 50 of die 40C. In yet other implementations, other tracing patterns or layouts may be employed.

One implementation, electrical interconnects 28 each comprise a flexible circuit. In another implementation, electrical interconnects 28 each comprise a rigid circuit board. Although system 20 is illustrated as including eight print head dies 40, in other implementations, system 20 may have other numbers of print head dies 40. For example, in one implementation in which media path 35 is 8.5 inches wide, system 20 comprises 10 staggered and overlapping print head dies 40 that collectively span the 8.5 inches. In other implementations, system 20 may have other configurations and dimensions to accommodate other media path widths.

Figure 4:
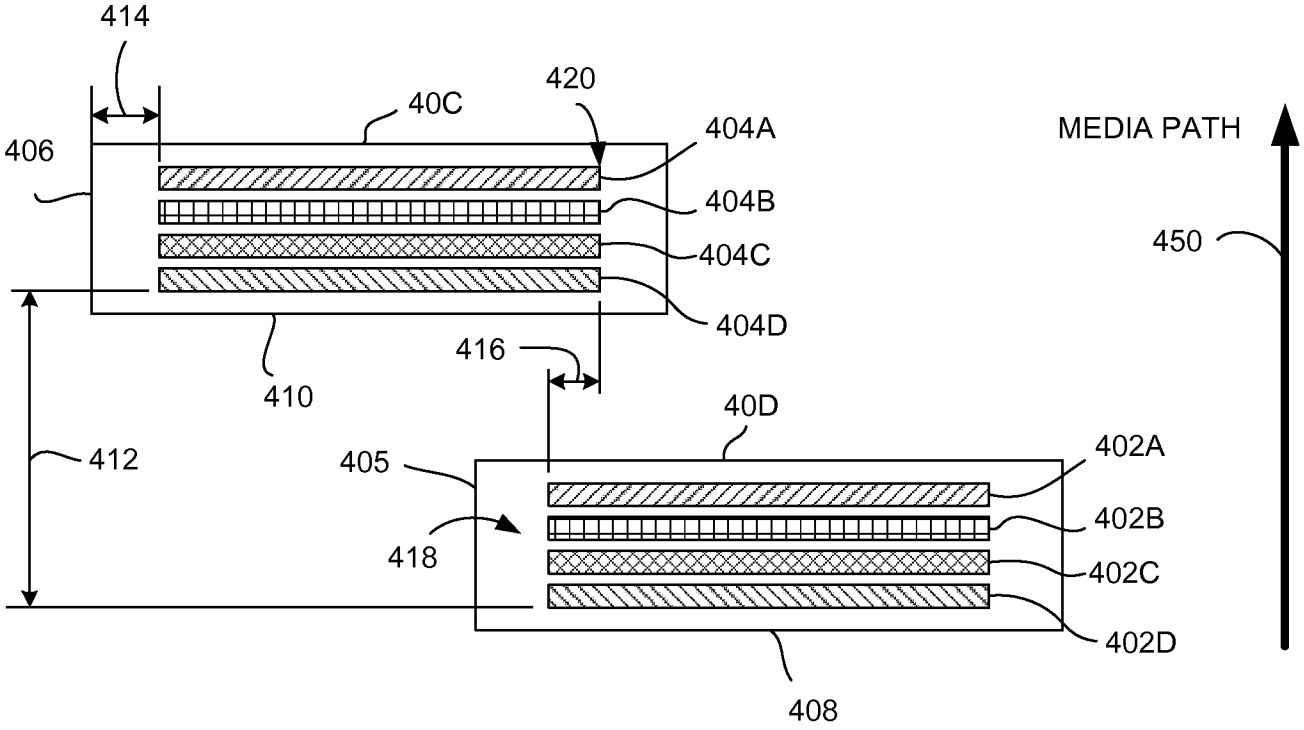
FIG. 4 illustrates a portion of one example arrangement of print head die on a page wide array.

FIG. 4 illustrates a portion of one example arrangement 400 of print head die on a page wide array. In this example, print head dies 40C and 40D of the page wide array 26 are shown. Print structures 404A, 404B, 404C, and 404D (collectively print structures 404) on print head die 40C represent four groups of slots and nozzles for ejecting ink onto a print medium (e.g., one each of cyan, magenta, yellow, and black inks). Likewise, print structures 402A, 402B, 402C, and 402D (collectively print structures 402) on print head 40D represent four groups of slots and nozzles for ejecting ink onto a print medium. Other specific details of print head dies 40C and 40D have been omitted for clarity, but it is to be understood that each such die can be configured as shown in FIG. 3 above. The print head die 40C includes a long edge 410 (major dimension) and a short edge 406 (minor dimension). The print head die 40D includes a long edge 408 (major dimension) and a short edge 405 (minor dimension).

An arrow 450 represents the direction the media moves along the media path. As described above, the page wide array includes two rows of staggered print head dies. For purposes of this example, assume the print head die 40D is in the first row, and the print head die 40C is in the second row. Other print head dies 40 in the first and second rows have been omitted for clarity. It is to be understood that other adjacent print head dies between the rows can have similar configuration as the print head dies 40C and 40D shown in FIG. 4.

With reference to the print head die 40C, a dimension 414 represents the distance between the print structures 404 and a short edge 406 of the print head die 40C. As shown in FIG. 3, the area between the print structures 404 and the short edge of the print head die 40C can be used to route electrical connections. There is a similar distance between the print structures 404 and an opposite short edge 420 of the die 40C. The print head die 40D has a similar configuration.

A dimension 412 represents a distance between a leading print structure on the die 40D (i.e., the print structure 402D) and a leading print structure on the die 40C (i.e., the print structure 404D). By "leading print structure", it is meant the one of the print structures on a print head die that comes first with respect to the direction of the media path. The dimension 412 is referred to herein as the "die-to-die stagger" or "die-die stagger".

A dimension 416 represents a distance between an edge 418 of the print structures 402 on the print head die 40D and an edge 420 of the print structures 404 on the print head die 40C. That is, a portion of the print structures 402 on the print head die 40D overlap a portion of the print structures 404 on the print head die 40C. The dimension 416 represents the extent of the overlap between print structures of the two print head die 40C and 40D. The dimension 416 is referred to herein as the "die-to-die print region overlap" or simply "overlap".

The die-to-die stagger allows time for an accumulation of errors in media position and can produce defects at the die boundary regions. In addition, low cost manufacturing processes do not allow for precise alignment of individual print head dies in the array. To account for this alignment variation, the printing regions of the die can be overlapped. The overlap provides a transition zone that can be used to minimize print defects and assure that nozzles are available to eject ink over the entire page in spite of print head die placement variation. The overlap, however, should be minimized to reduce individual die and total assembly costs. Thus, the selection of the overlap size can be critical for providing maximum print quality while minimizing costs.

During manufacture, print head die placement can vary from ideal placement. Lower cost manufacturing processes exhibit larger die placement variations. The inventors have determined that the minimum overlap necessary to assure coverage of the full width of the media is approximately equal to the amount of die placement variation of the manufacturing process used. At the same time, media movement errors increase with the distance the media is moved. The inventors have found that larger die-die staggers result in the need for larger overlaps. In addition, the inventors have found that print quality depends on the transition region established by the overlap.

For rectangular print heads having a particular die-die stagger, the optimal overlap is between a minimum value and a linear function of a separation between the respective leading print structures of adjacent and staggered print head dies. In an example, the minimum value is approximately equal to the die placement variation empirically determined from the manufacturing process used to place the print head die. Any overlap less than this minimum value can result in less than page-wide coverage and/or other degradations in print quality. The upper bound for the optimal overlap is a linear function of the die-die stagger. In an example, the linear function can have the form of bx+c, where c is the minimum value (e.g., die placement variation), x is the die-die staggar, and b is a positive real number. In a non-limiting example, the inventors have found that a value of 0.1 for b results in an optimal range for the overlap.

In a non-limiting example, some low cost manufacturing processes can exhibit die placement variation (dpv) of approximately 100 μm. An example die-die stagger is approximately 6000 μm. Thus, in this example, the optimal overlap is achieved between 100 μm and 700 μm (100 μm+6000 μm×0.1 μm). If the print head nozzles are arranged to provide 1200 dots per inch (dpi), the optimal die overlap for die-die stagger of 6000 μm expressed in terms of nozzles is between 5 and 33 nozzles. The conversion between nozzles and distance in pm given a particular dpi is understood by those skilled in the art.

The optimal overlap can be determined given different parameters using the general relationship described above. The larger the die-die stagger, the larger the range of optimal overlap. Conversely, the smaller the die-die stagger, the smaller the range of optimal overlap.

Figure 5:
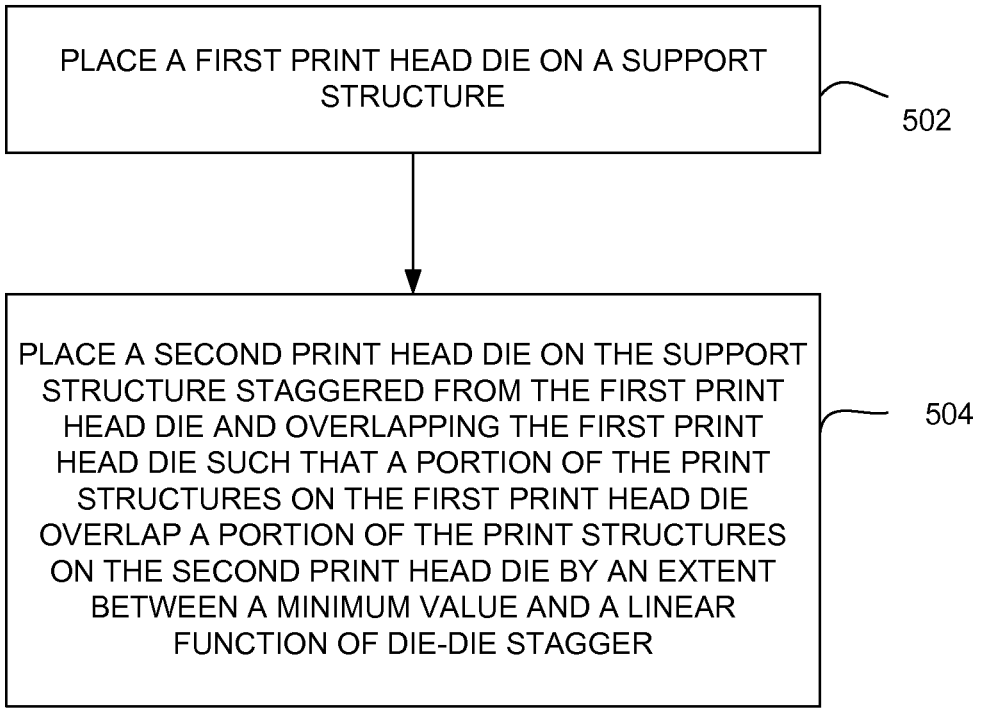
FIG. 5 is a flow diagram depicting a method of assembling a print bar to print on media moved along a media path according to an example implementation.

FIG. 5 is a flow diagram depicting a method 500 of assembling a print bar to print on media moved along a media path according to an example implementation. The method 500 begins at step 502, where a first print head die is placed on a support structure. At step 504, a second print head die is placed on the support structure staggered from the first print head die and overlapping the first print head die such that a portion of the print structures on first print head die overlap a portion of the print structures on the second print head die by an extent between a minimum value and a linear function of a separation between the respective leading print structures of the first and second print head dies. In an example, the minimum value is approximately equal to the die placement variation empirically determined from a manufacturing process used to place the first and second print head dies. In an example, the linear function is in the form of bx+c, where x is the die-die stagger, c is the minimum value, and b is a positive real number. In an example, b is approximately 0.1.

Returning to FIG. 4, optimal die overlap has been described above. Optimal die-die stagger is described below. The spatial separation of print heads in the direction of media movement (print head stagger) allows time for accumulation of errors in paper position, which can produce print defects at the die overlap regions. Generally speaking, lower cost media handling system will incur larger errors in the paper position. Additionally, the spatial separation in the media axis can affect the size and occurrence of defects created from instantaneous paper movement that is unmeasured and uncompensated. These movements are known to occur when cut-sheet media edges transition between pinches.

The spatial separation of print head dies in the direction of paper movement is a significant sender in the unconstrained printzone. This is a distance the paper must move through without constraint but must be controlled to remain as flat as possible to ensure dot shape and placement. Minimizing the separation allows for a lower cost reverse bow printzone to be utilized.

Fluidic routing needs are driven by a combination of manufacturability and air management. Air management requires a diverging fluidic cross section and large paths to enable fluid flow in the presence of air. Manufacturing cost and capability are also enabled by larger features and tolerances. For instance, plastic parts are difficult to mold a dimensions that are significantly less than 1 mm.

Minimum separation and overall width can be determined from die placement capabilities and die size. For example, Low cost manufacturing processes have approximately 100 μm of placement variation. In an example, Adding the width of the print head die to the die placement variation can be used to determine a minimum die-die stagger distance.

While the minimum die-die stagger distance is achievable and desirable for optimal print quality, use of such minimum distance can drive manufacturing cost and/or complexity and compromise fluidic routing. Larger values can be acceptable in lower cost page-wide printing systems. The maximum separation can be determined from a function of expected variation in position of the media and maximum allowable dot placement error for print defects.

In a non-limiting example, print head die width is approximately 5 mm. Assuming die placement variation of approximately 100 μm, the minimum value of the die-die stagger would be 5.1 mm. The inventors have determined, given an expected variation in media position and a desired maximum allowable dot placement error for a low cost single pass page-wide printing system, a maximum die-die stagger of 6 mm. Further, the distance along the media path between any slot on the first die and any slot on the second adjacent and staggered die should be no greater than 10 mm.

Using the optimal amount of die-die stagger will provide the lowest-cost single-pass printing system that produces good print quality. Optimizing die-die stagger allows the use of lower cost media handling solution, enables high speed printing, and does not require the use of expensive non-rectangular print head die.

Figure 6:
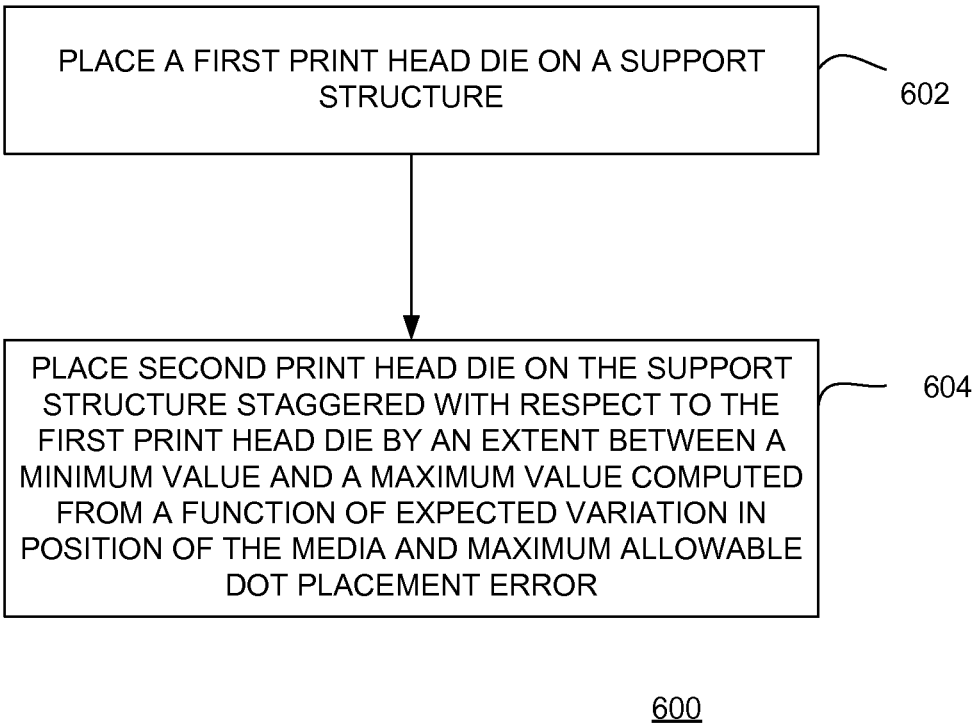
FIG. 6 is a flow diagram depicting a method of assembling a print bar to print on media moved along a media path according to an example implementation.

FIG. 6 is a flow diagram depicting a method 600 of assembling a print bar to print on media moved along a media path according to an example implementation. The method 600 begins at step 602, where a first print head die is placed on a support structure. At step 604, a second print head die is placed on the support structure staggered with respect to the first print head die by an extent between a minimum value and a maximum value computed from a function of expected variation in position of the media and maximum allowable dot placement error for the first and second print structures. In an example, the minimum value is equal to a width of the first or second print head die plus a die placement variation empirically determined from a manufacturing process used to place the first and second print head dies. In an example, the minimum value of die-die stagger for a 5 mm wide die is approximately 5.1 mm and the maximum value of die-die stagger is approximately 6 mm. In an example, a separation between any of the first print structures and any of the second print structures does not exceed approximately 10 mm.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. An apparatus to print on media moved along a media path, comprising:

a first print head die having first print structures disposed along a major dimension thereof perpendicular to the media path, the first print structures including a leading print structure with respect to the media path; and a second print head die independent of the first print head die, the second print head die having second print structures disposed along a major dimension thereof perpendicular to the media path, the second print head die being staggered with respect to the first print head die along the media path, the second print structures including a leading print structure with respect to the media path;

wherein an extent between respective leading print structures of the first and second print head dies is between a minimum value equal to a width of the first print head plus 100 μm and a maximum value such that the distance along the media path between any of the first print structures and any of the second print structures does not exceed 10 mm.

2. The apparatus of claim 1, wherein the minimum value is equal to a width of the first or second print head die plus a die placement variation empirically determined from a manufacturing process used to place the first and second print head dies.

3. The apparatus of claim 1, wherein the maximum value is 6 mm.

4. The apparatus of claim 1, wherein the minimum value is approximately 5.1 mm and the maximum value is approximately 6 mm.

5. The apparatus of claim 4, wherein the first print head die and the second print head die have an overlap 100 μm in 700 μm.

6. The apparatus of claim 1, wherein the first print head die and the second print head die have an overlap of between 5 and 33 nozzles.

7. An apparatus to print on media moved along a media path, comprising:

a first row of independent print head dies spanning across the media path, each of the print head dies in the first row having print structures including a leading print structure with respect to the media path;

a second row of independent print head dies spanning across the media path staggered with respect to the first row along the media path, each of the print head dies in the second row having print structures including a leading print structure with respect to the media path;

wherein an extent between respective leading print structures of print head dies in the first row and print head dies in the second row is between a minimum value equal to a width of the first print head dies in the first row plus 100 μm and a maximum value such that the distance along the media path between any of the print structures of the print head dies in the first row and any of the print structures of the print head dies in the second row does not exceed 10 mm.

8. The apparatus of claim 7, wherein the minimum value is equal to a die width plus a die placement variation empirically determined from a manufacturing process used to place the first and second rows of print head dies.

9. The apparatus of claim 8, wherein the maximum value is 6 mm.

10. The apparatus of claim 7, wherein the minimum value is approximately 5.1 mm and the maximum value is approximately 6 mm.

11. The apparatus of claim 7, wherein the print head dies of the first row and the print head dies of the second row each an overlap 100 μm and 700 μm.

12. The apparatus of claim 7, wherein the print head dies of the first row and the print head dies of the second row have an overlap of between 5 and 33 nozzles.

13. A method of assembling a print bar to print on media moved along a media path, comprising:

placing a first print head die on a support structure, the first print head die having first print structures disposed along a major dimension thereof perpendicular to the media path, the first print structures including a leading print structure with respect to the media path; and placing a second print head die on the support structure, the second print head die having second print structures disposed along a major dimension thereof perpendicular to the media path, the second print head die being placed such that the second print head die is staggered with respect to the first print head die along the media path, the second print structures including a leading print structure with respect to the media path, a separation between respective leading print structures of the first and second print head dies is between a minimum value equal to a width of the first print head die plus 100 μm and a maximum value such that the distance along the media path between any of the print structures of the first print head die and any of the print structures of the second print head die does not exceed 10 mm.

14. The method of claim 13, wherein the minimum value is equal to a width of the first or second print head die plus a die placement variation empirically determined from a manufacturing process used to place the first and second print head dies.

15. The method of claim 13, wherein the minimum value is approximately 5.1 mm and the maximum value is approximately 6 mm.

16. The method of claim 13, wherein the first print head die and the second print head die have an overlap 100 μm and 700 μm.

17. The method of claim 13, wherein the first print head die and the second print head die have an overlap of between 5 and 33 nozzles.

* * * * *